US012753483B2

(12) United States Patent
Grunenwald et al.

(10) Patent No.: US 12,753,483 B2
(45) Date of Patent: Oct. 6, 2026

(54) METHOD FOR SURFACE TREATMENT BY SELECTIVE REMOVAL OF A BONDING PRIMER ON A TITANIUM OR TITANIUM ALLOY SUBSTRATE

(71) Applicant: SAFRAN AIRCRAFT ENGINES, Paris (FR)

(72) Inventors: Anthony Grunenwald, Moissy-Cramayel (FR); Pierre Antoine Bossan, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 648 days.

(21) Appl. No.: 18/256,184

(22) PCT Filed: Nov. 29, 2021

(86) PCT No.: PCT/FR2021/052114
§ 371 (c)(1),
(2) Date: Jun. 6, 2023

(87) PCT Pub. No.: WO2022/123141
PCT Pub. Date: Jun. 16, 2022

(65) Prior Publication Data

US 2024/0018640 A1 Jan. 18, 2024

(30) Foreign Application Priority Data

Dec. 9, 2020 (FR) ..... 2012880

(51) Int. Cl.
*C23C 8/16* (2006.01)
*C23C 8/80* (2006.01)
*C23G 1/20* (2006.01)

(52) U.S. Cl.
CPC ..... *C23C 8/16* (2013.01); *C23C 8/80* (2013.01); *C23G 1/205* (2013.01)

(58) Field of Classification Search
CPC ..... C23G 1/205
See application file for complete search history.

(56) References Cited

U.S. PATENT DOCUMENTS 5,395,461 A * 3/1995 Taki ..... C23C 8/80 148/281
2004/0187983 A1* 9/2004 Yashiki ..... C22C 14/00 148/670

(Continued)

FOREIGN PATENT DOCUMENTS

CA 2 870 523 A1 5/2016
FR 3 056 605 A1 3/2018

(Continued)

OTHER PUBLICATIONS

International Search Report mailed Jan. 27, 2022, issued in corresponding International Application No. PCT/FR2021/052114, filed Nov. 29, 2021, 5 pages.

(Continued)

*Primary Examiner* — Christopher S Kessler
(74) *Attorney, Agent, or Firm* — CHRISTENSEN O'CONNOR JOHNSON KINDNESS PLLC

(57) ABSTRACT

A method for treating the surface of a titanium or titanium alloy metal reinforcement of a blade made of composite material enables selective removal of a bonding primer with respect to the titanium or titanium alloy reinforcement. The method includes subjecting the metallic reinforcement to a thermal treatment performed at a temperature of between 250 and 350° C. for a period of between 1 hour and 10 hours in an oxidizing atmosphere. The method further includes subjecting the metallic reinforcement, after the thermal treatment, to a chemical pickling in an alkaline bath.

8 Claims, 3 Drawing Sheets

BA pickled + thermal treatment at 300 + 50°C
Oxide layer approx. 125 nm

(56) References Cited

U.S. PATENT DOCUMENTS

| | | | | |
|---|---|---|---|---|
| 2005/0284544 | A1* | 12/2005 | Yamamoto | C23C 18/04 148/269 |
| 2009/0211667 | A1* | 8/2009 | Suzuki | H01M 8/0215 148/281 |
| 2015/0280251 | A1* | 10/2015 | Takahashi | C22C 14/00 429/509 |

FOREIGN PATENT DOCUMENTS

| | | | |
|---|---|---|---|
| JP | H08246192 | A | 9/1996 |
| JP | 2002120495 | A | 4/2002 |

OTHER PUBLICATIONS

Written Opinion mailed Jan. 27, 2022, issued in corresponding International Application No. PCT/FR2021/052114, filed Nov. 29, 2021, 5 pages.

* cited by examiner

BA pickled + thermal treatment at 300 + 50°C
Oxide layer approx. 125 nm

METHOD FOR SURFACE TREATMENT BY SELECTIVE REMOVAL OF A BONDING PRIMER ON A TITANIUM OR TITANIUM ALLOY SUBSTRATE

FIELD OF THE DISCLOSURE

The present disclosure concerns the field of the vanes made of composite materials with an organic matrix or a ceramic matrix, for example vanes referred to as FAN or fan vanes, comprising a metallic reinforcement, in particular of titanium or titanium alloy, intended for turbine engines or turbojet engines, in particular of the aeronautical type.

In particular, the present disclosure relates to a method for treating the surface of a titanium or titanium alloy metallic reinforcement of a vane made of composite material, which method allows the selective removal of a bonding primer with respect to the titanium or titanium alloy reinforcement.

BACKGROUND

The turbine engine fan vanes, particularly of the aeronautical type, are subject to significant mechanical stresses, particularly in view of their speed of rotation, while at the same time having to satisfy strict weight and overall dimension requirements. One of the options considered for lightening the vanes is the use of organic matrix composite material, for example fibre-reinforced polymers such as carbon fibre, for their manufacture. However, fan vanes must also meet stringent operating criteria, in particular they must resist to foreign bodies impact: bird ingestion, hail, ice, grit, etc. However, the composite material, in particular on the vane edge, can be brittle and not sufficiently resistant to the impacts and to the ingestions during operation.

To overcome this problem, it was envisaged to protect the front of the fan vanes made of composite material by consolidating the leading edge (also referred to as BA) of the vane with a metallic reinforcement, in particular titanium or titanium alloy, which would be integrated into the aerodynamic profile of the vane. Such a metallic reinforcement part, which protects the composite from impact and ingestions, is then assembled by bonding to the leading edge of the composite vane.

The surface preparation of the reinforcement of the leading edge may involve a surface treatment method by chemical pickling followed by the application of a bonding primer to improve the adhesion properties with the adhesive. The poorly controlled application of the primer (incorrect thickness, polluted surfaces, etc.), its expiry after application (>6 months) or pollution and defects such as scratches generated during transport and/or storage of the BA, lead to the parts being rejected for bonding.

The resins that make up the primer are very stable chemically and mechanically. The technical challenge to overcome consists in removing the primer without damaging the tightly ribbed titanium or titanium alloy substrate, and being able to check the presence of primer residues.

A range of alkaline chemical pickling to remove the primer followed by the preparation range before classic bonding (pickling+primer) is validated to touch up the impacted BA.

However, this range of alkaline chemical pickling to remove the primer is not very effective, and leads to a combined chemical attack of the primer and the titanium alloy substrate. However, the leading edge has a thin substrate thickness at the level of the fins, which cannot accept too much chemical attack. The repair is therefore only applicable to BA whose geometric tolerances can accept a loss of thickness of the order of 15 to 20 μm per face.

The mechanical dry pickling with plastic media has also proven ineffective.

There is therefore a real need for a surface treatment method to selectively remove the bonding primer with respect to the titanium or titanium alloy substrate.

SUMMARY

The present disclosure is intended to meet precisely this need by proposing a method that is effective at the removal of the primer while minimising the attack of the titanium or titanium alloy substrate and hence the thickness of material removed. The mechanical characteristics of the substrate are thus preserved by this method.

For this purpose, the disclosure relates to a method for treating a surface of a metallic reinforcement made of titanium or titanium alloy of a vane, in particular of a vane made of composite material, characterised in that it comprises the following steps:

A) subjecting the metallic reinforcement to a thermal treatment performed at a temperature of between 25° and 350° C. for a period of between 1 hour and 10 hours in an oxidising atmosphere; and B) subjecting the metallic reinforcement, after the thermal treatment in step A), to chemical pickling in an alkaline bath comprising the following steps:

B-1) cleaning/degreasing (optional step);

B-2) pickling in alkaline medium;

B-3) neutralising;

B-4) final rinsing.

The composite material may be organic matrix or ceramic matrix.

The organic matrix can be, for example, a fibre-reinforced polymer, in particular carbon fibre.

The vane may be a fan vane.

It has been found, quite unexpectedly, that the method of the disclosure allows the selective removal of the primer with respect to the very lightly attacked titanium or titanium alloy substrate (thickness of material removed <1 μm), in the same chemical pickling bath, thanks to the prior growth of a thin protective layer of titanium oxide (of the order of 100 to 130 nm), generated by the thermal treatment of step A). The thermal treatment in step A) also leads to a degradation of the bonding primer, in particular by its oxidation, which facilitates its removal.

As the chemical attack on the titanium or titanium alloy reinforcement has been substantially reduced by the method of the disclosure, the repair thus becomes applicable to any type of titanium alloy, with geometric tolerance restrictions when they are less than 2 μm, for example, 1 μm.

In addition, the associated chemical pickling in step B) can also act as a developer to check the primer residues in final inspection. The chemical pickling oxidises the primer to a yellowish appearance, which allows the presence of residues to be visually checked if the primer is not completely removed.

The method of the disclosure applies to the surface treatment of a leading edge equipped with a metallic reinforcement made of titanium or a titanium alloy of a vane made of composite material, intended for turbine engines or turbojet engines, in particular of the aeronautical type. Such turbine engines or turbojet engines may be LEAP-GEN1, LEAP-GEN2 engines, for example.

DESCRIPTION OF THE DRAWINGS

Further characteristics and advantages of the disclosure will become apparent from the following detailed description, for the understanding of which reference is made to the attached drawings in which:

In FIG. 1A, the sample has been subjected to a chemical pickling only according to the prior art described above, and In FIG. 1B, the sample was subjected to a chemical pickling according to the disclosure after carrying out a thermal treatment (step A) at 300±50° C. for 4 hours in air.

The analyses XPS were carried out with the apparatus THERMO Scientific K-alpha+. Thus, it is clear that the thermal treatment in step A) induces an increase in the oxide layer on the surface of the titanium alloy.

Figure 2:
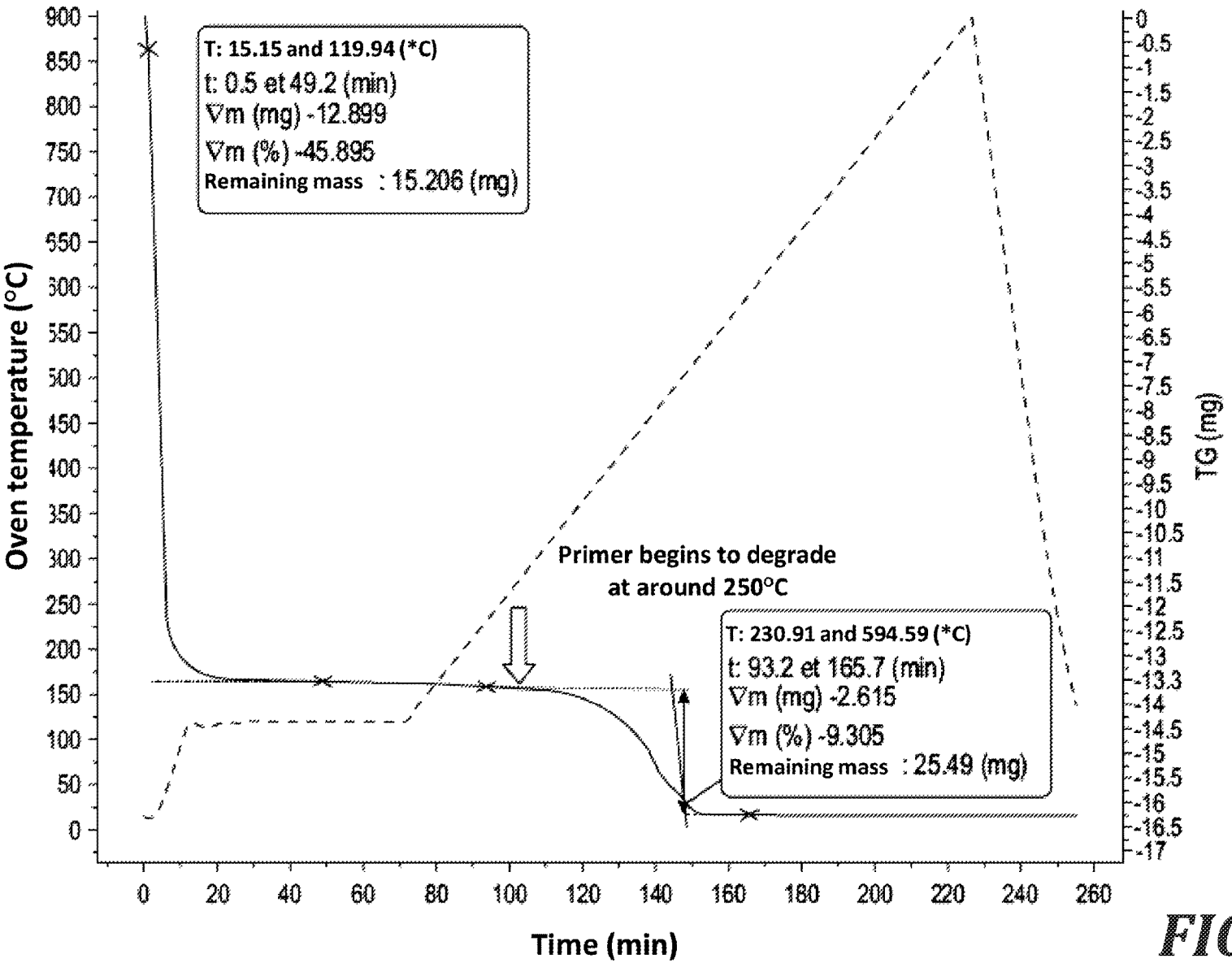

FIG. 2 shows the thermogravimetric analysis (ATG) of the primer performed in air and carried out with a ATG SETARAM. This thermal analysis technique consists of measuring the change in mass of the sample as a function of time, for a given temperature or temperature profile. Thus, on a titanium alloy sample as specified above, having been subjected to a thermal treatment according to step A) of the method of the disclosure, it is clear that the degradation of the primer starts at around 250° C. A loss of mass from 250° C. is thus noted. Indeed, the degradation starts around this temperature and continues all the faster as the temperature rises. The technique allowed the choice of a 300° C. treatment to degrade the primer.

DETAILED DESCRIPTION

The disclosure relates to a method for the surface treatment of a metallic reinforcement made of titanium or titanium alloy of a vane, in particular of a vane made of composite material, characterised in that it comprises the following steps:

A) subjecting the metallic reinforcement to a thermal treatment performed at a temperature of between 25° and 350° C. for a period of between 1 hour and 10 hours in an oxidising atmosphere; and B) subjecting the metallic reinforcement, after the thermal treatment in step A), to chemical pickling in an alkaline bath comprising the following steps:

B-1) cleaning/degreasing (optional step);

B-3) neutralising;

B-4) final rinsing.

The composite material may be organic matrix or ceramic matrix.

The organic matrix can be, for example, a fibre-reinforced polymer, in particular carbon fibre.

The vane may be a fan vane.

Titanium alloys are alloys with a majority titanium mass content. It is understood that titanium is therefore the element with the highest mass content in the alloy. The titanium-based alloy has, for example, a mass content of at least 50% titanium, preferably at least 70% titanium, even more preferably at least 80% titanium. The titanium alloy can be chosen, for example, from the range of alloys of the type Ti 40, TA6V (also referred to as Ti-6Al-4V), which is widely used in aeronautic, Ti 10-2-3 (also referred to as Ti 10V 2Fe 3Al), Ti 5553 (also referred to as Ti-5Al-5Mo-5V-3Cr), Ti 17 (also referred to as Ti-5Al-2Sn-2Zr-4Mo-4Cr), TiAl (titanium-aluminium alloy), and Ti6242 (also referred to as Ti-6Al-2Sn-4Zr-2Mo).

"Vane" in the context of the disclosure means both the fan vanes and the aerial propeller blades. One embodiment of the disclosure is the fan vanes.

The bonding primer, which allows to increase the adhesion of the adhesives for the assembly of the metallic reinforcement with the BA of the composite vane, can be made of epoxy resin, phenolic resin or epoxy-phenolic resin, pre-dried after application on titanium alloy. Such primers are well known to the person skilled in the art, particularly in the field of aeronautics. The bonding primer is advantageously made of epoxy resin, phenolic resin or epoxy-phenolic resin. These resins are very stable chemically and mechanically. Removing the primer without altering the geometrically tight titanium or titanium alloy reinforcement and being able to check the presence of primer residue is a real technical challenge that the inventors have been able to overcome by developing the method of the disclosure.

The method of the disclosure allows the primer to be pickled almost selectively from the titanium or titanium alloy substrate. The thermal oxidation of the metallic reinforcement in step A) degrades the primer on one side and oxidises the titanium on the other side to give it a temporary protection during the chemical pickling in step B). In the case of the FAN vane, this method allows to greatly limit the loss of thickness of the fine fins of the leading edge, unlike the current chemical treatment, and thus to preserve the geometric conformity of the part.

The thermal treatment temperature must therefore be selected to avoid any geometric deformation of the part or metallurgical modification of the metal or of the metallic alloy. It must also be sufficiently large to ensure that the primer (which is very stable at high temperatures because it is made of an epoxy and/or phenolic resin) does not degrade.

The thermal treatment in step A) takes place at a temperature of between 25° and 350° C.

The thermal treatment in step A) is advantageously performed in an oxidising atmosphere leading to the formation of an oxide layer on the surface of the titanium or titanium alloy substrate. In a preferred embodiment of the disclosure, the thermal treatment is performed in air.

The duration of the thermal treatment in step A) leads to the formation of an oxide layer with a thickness of more than 80 nm, preferably 100 nm or more, for example 125 nm or more, on the surface of the titanium or titanium alloy substrate. The duration of the thermal treatment can be between 1 hour and 10 hours, between 1 hour and 8 hours, between 2 and 6 hours, for example, between 2 and 4 hours.

The thermal treatment can be performed in any type of device allowing the thermal treatment of a metallic reinforcement made of titanium or titanium alloy of a vane, and known to the person skilled in the art. For example, the device can be a prover or a convection oven with a filtered air circulation to avoid pollution. The apparatus will of course be temperature-calibrated to comply with the instructions.

According to an embodiment of the disclosure, the surface treatment method according to the disclosure comprises a thermal treatment step performed at a temperature between 250 and 350° C.;

in air;

with a duration of between 2 and 4 hours; and leading to an oxide layer of the titanium or titanium alloy substrate of 100 nm or more. It may be, for example, 125 nm.

After the thermal treatment step A), the metallic reinforcement is subjected to a chemical pickling allowing to remove the previously thermally formed oxide superficial layer of the titanium or titanium alloy substrate and to remove the bonding primer oxidised during the thermal treatment A).

The pickling step allows to obtain a satisfactory surface condition for the subsequent treatments.

The chemical pickling step B) is advantageously a chemical pickling in an alkaline bath comprising the following steps:

B-1) cleaning/degreasing;

B-2) pickling in alkaline medium;

B-3) neutralising;

B-4) final rinsing.

Note that step B-1) is optional.

The cleaning/degreasing operations (B-1)) may start with a "pre-degreasing", consisting in using organic solvents to solubilise the majority of grease and oil on the surface of the parts. This operation can be carried out by dipping or immersion, sprinkling, or any other method known to the person skilled in the art. For the titanium and the titanium alloys, the solvents that can be used are selected from acetone, methyl ethyl ketone, white spirit, etc. A mixture of solvents selected from those mentioned may also be used. To effectively remove mineral oils, synthetic lubricating oils, combustion residues, atmospheric deposits and runway deposits, solvent pre-degreasing is usually followed by an "alkaline degreasing" operation in a dip tank, involving complex physico-chemical processes between the pollutant particles and the constituents of the bath. These degreasing baths, which are generally commercial formulations, ensure the complete removal of the greasy films. The alkaline degreasing baths include, for example, Turco® 5948 DPM from the company Henkel. The temperatures and times for this step depend on the products. The temperature can be between 40° C. and 70° C. and the duration between 5 and 10 minutes. It should be noted that "alkaline degreasing" can take place without a prior "pre-greasing".

The alkaline degreasing may be followed by rinsing with water. After alkaline degreasing and rinsing with water, the surface is clean and ready for the next step.

The pickling operation B-2) is intended to remove all traces of oxides formed in particular following the thermal treatment in step A). The pickling operation allows to provide freshly active surfaces before the application of a bonding primer. The alkaline pickling baths are usually commercial formulations. Commercial alkaline pickling baths include, for example, Turco® 5578 GL from the company Henkel.

This can be carried out by dipping or immersion, sprinkling, or any other technique known to the person skilled in the art.

For the alkaline pickling operation B-2), the attack rate of the titanium or titanium alloy substrate in the alkaline pickling bath, which is measured by the mass loss before and after chemical attack, must remain low, i.e. less than 0.5 μm/min/face, preferably less than or equal to 0.3 μm/min/face, more preferably less than or equal to 0.2 μm/min/face, for example less than or equal to 0.10 μm/min/face (compared with 0.5 μm/min/face usually on non-thermally oxidised titanium or titanium alloys). The presence of titanium oxide has completely altered the attack of the titanium or titanium alloy substrate and slows down the attack kinetics. The thickness removed should remain small. The removal of the titanium thickness should therefore preferably be less than 1 μm/face for the treatment time applied, which allows the geometric dimensions of the original part to be retained.

Thus, the parts to be treated in the alkaline pickling bath can be treated for a period of less than or equal to 30 minutes, preferably less than or equal to 20 minutes, more preferably less than or equal to 10 minutes. The treatment time in the alkaline pickling bath may be, for example, less than or equal to 5 minutes.

The titanium oxide once removed for a pickling time of 5 minutes or more, for example, makes the part suitable for a preparation according to the conventional surface preparation range before bonding (pickling+primer) thereafter.

In addition, a temperature control is necessary because the attack rate can be multiplied by 1.5 or 2 for a 10° C. rise in bath temperature. The temperature of the alkaline pickling bath is therefore maintained at between 8° and 95° C. The bath can be subjected to a stirring by pumping/circulation.

After the alkaline pickling in step B-2), an acid neutralisation step B-3) is necessary. This can be carried out by dipping or immersion, sprinkling, or any other technique known to the person skilled in the art. This neutralisation can be done with a bath comprising the nitric acid. The nitric acid can be diluted <50%.

Intermediate rinsing, in particular with demineralised water, may be carried out between the above successive steps, and after the thermal treatment in step A).

The neutralisation step is followed by a final rinsing step B-4). The purpose of this step is to remove the chemical product residues, and to provide a clean surface for further operations, such as assembling the metallic reinforcement by bonding to the leading edge of the composite vane.

The final rinsing can be done preferably with deionised or demineralised water. It can be done by immersion or by sprinkling or spraying. The rinsing by sprinkling or spraying allow in many cases to optimise rinsing by limiting the amount of water used. The quality of rinsing can be improved by simultaneously using compressed air to spray the water (hydromechanical effect). This type of rinsing is well known to the person skilled in the art.

In addition to the aeronautical industry, the method of the disclosure can be of great interest in any type of industry where a surface treatment involving a selective pickling step is required, such as in the automotive industry.

Another object of the disclosure concerns a method for repairing a leading edge of a vane, in particular a vane made of composite material, equipped with a metallic reinforcement made of titanium or titanium alloy, implementing a surface treatment method according to the disclosure.

Another object of the disclosure concerns a method for assembling a metallic reinforcement made of titanium or titanium alloy by bonding it to a leading edge of a vane, in particular a vane made of a composite material, implementing a surface treatment method according to the disclosure.

The disclosure also relates to the use of a surface treatment method according to the disclosure for controlling the presence of primer residues in the final inspection of a metallic reinforcement made of titanium or titanium alloy, of a leading edge of a vane, in particular of a vane made of composite material, for example before the assembly operation.

Other advantages and characteristics of the disclosure will become apparent from the examples given below by way of illustration.

EXAMPLES

Example 1

Method for Treating the Surface of a BA Equipped with a Titanium Alloy Metallic Reinforcement A BA of a 3D woven carbon fibre reinforced organic matrix composite material vane equipped with a reinforcement made of titanium alloy Ti-6Al-4V is treated by the method of the disclosure as described below.

A) Carrying out of a thermal treatment at 300±50° C. for 4 hours in air.

Figure 1A:
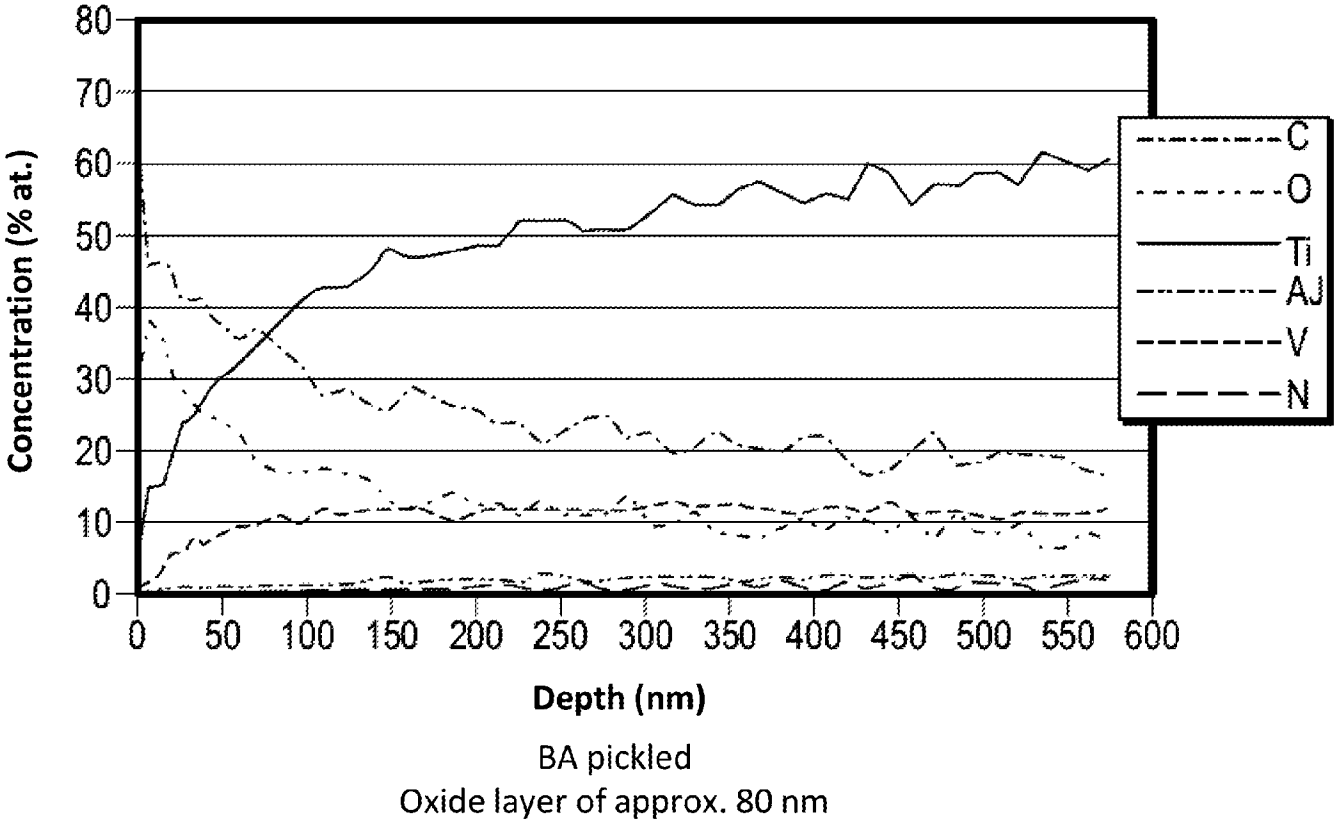
FIGS. 1A and 1B show the spectra made with X-Ray photoelectron spectrometry (XPS) allowing to determine the surface condition of two samples of a titanium alloy reinforcement TA6V.
Figure 1B:
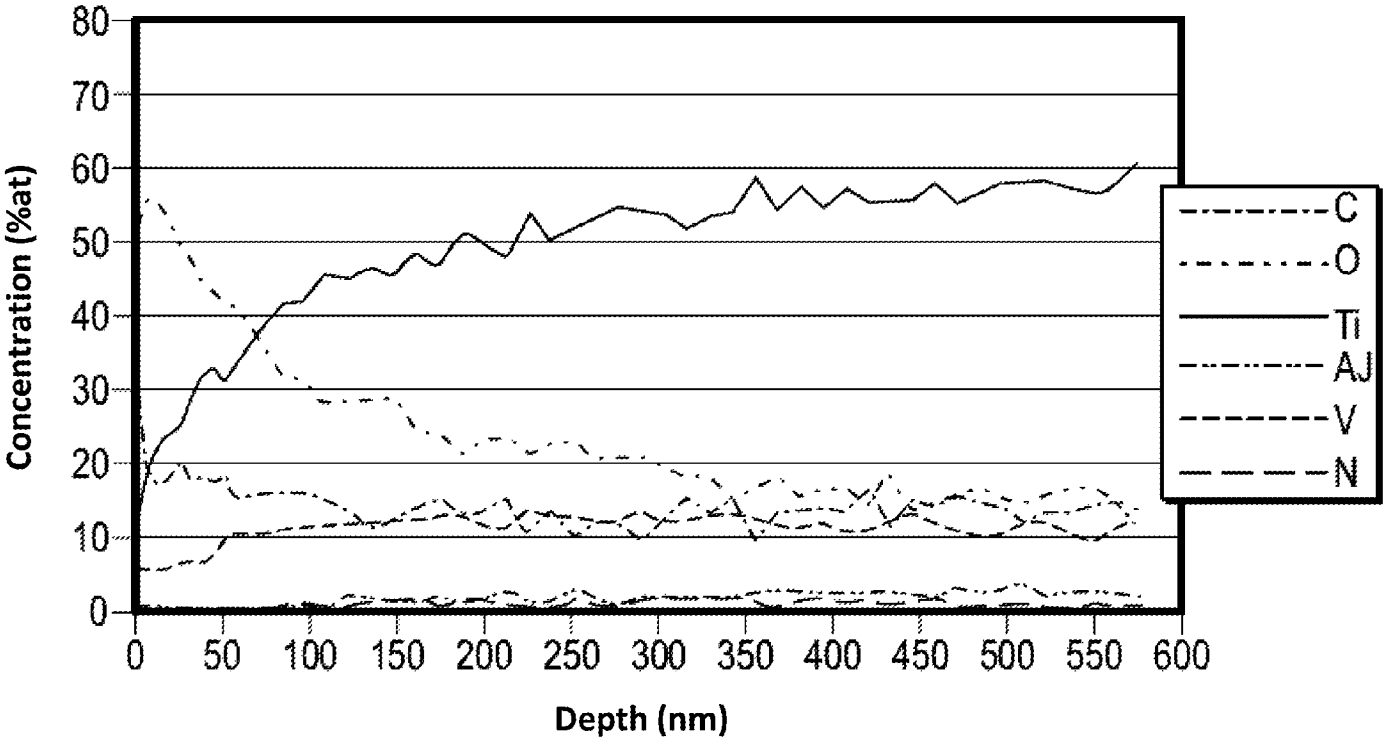

This treatment leads to an increase in the oxide layer on the surface of the titanium alloy. The thickness of the oxide layer formed is about 125 nm. The formation of this oxide layer on the surface of the titanium alloy was confirmed by the X-ray induced photoelectron spectrometry as shown in FIG. 1B.

This treatment also induces a degradation of the primer confirmed by a thermogravimetric analysis in air as shown in FIG. 2.

B) Chemical pickling in an alkaline bath of the primer and of the alloy previously thermally oxidised according to the following range:

B-1) Alkaline degreasing in a Turco® 5948 DPM bath;

B-2) Alkaline pickling with Turco® 5578GL for a duration≤5 minutes;

B-3) Neutralising with nitric acid; and

B-4) Deionised water immersion rinsing and spray rinsing.

The attack rate of the titanium alloy in the Turco5578GL bath (measured by the mass loss before and after chemical attack) is low (0.10 μm/min/face compared to the usual 0.5 μm/min/face on non-thermally oxidised titanium). The presence of titanium oxide has completely altered the attack of the titanium substrate and slows down the attack kinetics. The removal in titanium thickness is less than 1 μm/face for the treatment time applied, which allows the geometric dimensions of the original part to be retained.

The titanium oxide removed for a pickling time of 5 minutes or more predisposes the parts for an application of the conventional surface preparation range before bonding (pickling+primer) afterwards.

Control of the Parts

The BA are systematically primer-free at the end of the chemical pickling range of up to 5 minutes after thermal treatment, compared to 15 minutes of pickling for the current range (without thermal treatment).

The alkaline chemical pickling allows to reveal the presence or absence of primer by yellowing the latter. It is therefore indispensable in the range as no other method allows the control of the residual presence of primer without fine analysis on a laboratory scale.

As a comparative example, an identical part that has only been subjected to a chemical pickling operation according to step B) for 15 minutes (without thermal treatment) shows residual traces of primer in yellow.

The same part subjected to a thermal treatment at 300° C. (step A) followed by 5 minutes of chemical pickling according to step B) shows no trace of primer and reduced attack of the titanium alloy fins due to the titanium oxides.

The surface treatment method of the disclosure is therefore effective in removing the bonding primer while minimising attack on the titanium or titanium alloy substrate. Furthermore, the chemical pickling in step B) in combination with the thermal treatment step A) also acts as a developer to check the primer residues in final inspection.

The invention claimed is:

1. A method for treating a surface of a metallic reinforcement made of titanium or titanium alloy of a vane, comprising the steps of:

A) subjecting the metallic reinforcement to a thermal treatment performed at a temperature of between 25° and 350° C. for a period of between 1 hour and 10 hours in an oxidizing atmosphere; and B) subjecting the metallic reinforcement, after the thermal treatment in step A), to a chemical pickling in an alkaline bath, comprising the substeps of:

B-2) pickling in alkaline medium;

B-3) neutralizing; and

B-4) final rinsing.

2. The surface treatment method according to claim 1, wherein the thermal treatment of step A) leads to the formation of an oxide layer with a thickness greater than 80 nm on the surface of the titanium or titanium alloy substrate.

3. The surface treatment method according to claim 1, wherein the thermal treatment is performed in air.

4. The surface treatment method according to claim 1, wherein the thermal treatment:

is performed in air;

has a duration of between 2 and 4 hours; and leads to an oxide layer of the titanium or titanium alloy substrate of 100 nm or more.

5. The surface treatment method according to claim 1, wherein an attack rate of the titanium or titanium alloy substrate in the alkaline pickling bath of substep B-2) remains below 0.5 μm/min/face.

6. The surface treatment method according to claim 1, wherein the treatment time in the alkaline pickling bath is less than or equal to 30 minutes.

7. The surface treatment method according to claim 1, wherein the chemical pickling of step B) further comprises the substep of:

B-1) cleaning/degreasing in an alkaline degreasing bath, wherein:

the substep B-2) of pickling in alkaline medium uses an alkaline pickling bath, for a period of less than or equal to 5 minutes, at a temperature of between 8° and 95° C.;

the substep B-3) of neutralizing uses a bath comprising nitric acid; and the substep B-4) of final rinsing uses deionized water.

8. The surface treatment method according to claim 1, wherein step B) further includes the substep of:

B-1) cleaning/degreasing before substep B-2).

* * * * *